US008225591B2

(12) United States Patent
Johnson et al.

(10) Patent No.: US 8,225,591 B2
(45) Date of Patent: Jul. 24, 2012

(54) APPARATUS AND FILTERING SYSTEMS RELATING TO COMBUSTORS IN COMBUSTION TURBINE ENGINES

(75) Inventors: Thomas Edward Johnson, Greer, SC (US); Baifang Zuo, Simpsonville, SC (US); Christian Xavier Stevenson, Inman, SC (US)

(73) Assignee: General Electric Company, Schenectady, NY (US)

( * ) Notice: Subject to any disclaimer, the term of this patent is extended or adjusted under 35 U.S.C. 154(b) by 94 days.

(21) Appl. No.: 12/848,580

(22) Filed: Aug. 2, 2010

(65) Prior Publication Data

US 2012/0023895 A1 Feb. 2, 2012

(51) Int. Cl.
*F02G 3/00* (2006.01)

(52) U.S. Cl. ..... 60/39.092; 60/760

(58) Field of Classification Search .. 60/39.091–39.092, 60/752–760, 264; 55/306–308, 350.1, 385.3, 55/486, 488; 431/114, 188, 278, 284–285, 431/354–355

See application file for complete search history.

(56) References Cited

U.S. PATENT DOCUMENTS

| | | | | |
|---|---|---|---|---|
| 3,392,710 | A | 7/1968 | Demarest | |
| 3,871,844 | A | 3/1975 | Calvin, Sr. | |
| 4,077,739 | A * | 3/1978 | Heilenbach | 415/121.2 |
| 4,158,449 | A * | 6/1979 | Sun et al. | 244/136 |
| 6,302,932 | B1 * | 10/2001 | Unger et al. | 55/306 |
| 7,625,415 | B2 * | 12/2009 | Durocher et al. | 55/306 |
| 2011/0083419 | A1 * | 4/2011 | Upadhyay et al. | 60/264 |
| 2011/0146294 | A1 * | 6/2011 | Townsend | 60/779 |

* cited by examiner

*Primary Examiner* — Louis Casaregola
*Assistant Examiner* — Phutthiwat Wongwian
(74) *Attorney, Agent, or Firm* — Mark E. Henderson; Ernest G. Cusick; Frank A. Landgraff

(57) ABSTRACT

A combustor for a combustion turbine engine, the combustor that includes: a chamber defined by an outer wall and forming a channel between windows defined through the outer wall toward a forward end of the chamber and at least one fuel injector positioned toward an aft end of the chamber; a screen; and a standoff comprising a raised area on an outer surface of the outer wall near the periphery of the windows; wherein the screen extends over the windows and is supported by the standoff in a raised position in relation to the outer surface of the outer wall and the windows.

21 Claims, 12 Drawing Sheets

APPARATUS AND FILTERING SYSTEMS RELATING TO COMBUSTORS IN COMBUSTION TURBINE ENGINES

It is believed that this invention was made with Government support under Contract No. DE-FC26-05NT42643 awarded by the Department of Energy. It is believed, therefore, that the Government has certain rights in the invention

BACKGROUND OF THE INVENTION

This present application relates generally to apparatus and systems for improving the efficiency, performance and/or operation of combustors in combustion turbine engines. More specifically, but not by way of limitation, the present application relates to apparatus and systems for improved air inlets, air filters and/or flow conditioners within combustors. (Note that, while the present invention is presented below in relation to one of its preferred usages within the combustion system of a power generating combustion turbine engine, those of ordinary skill in the art will appreciated that the usage of the invention described herein is not so limited, as it may be applied to other types of combustion turbine engines.)

Those of ordinary skill in the art will appreciate that combustion turbine engines may operate combustors that include microchannel fuel injectors. A microchannel fuel injector is so named because it introduces the fuel/air mixture through a series of small channels. These types of fuel injectors are effective at delivering a desired flow of pre-mixed fuel to the combustion chamber and provide performance advantages in certain applications as well as allowing flexibility as to the type of fuel the engine is able to burn. However, this type of fuel injector, which will be referred to herein as a "microchannel fuel injector", is susceptible to blockage from small particles that may be contained in the stream of compressed air that the compressor supplies to the combustor. That is, the microchannels may become clogged by small particles that, in most conventional fuel injectors, would have not been problematic. Such clogging generally results in poor engine performance and may cause significant damage to the fuel injector and the combustion system. In some cases, the blockage actually results in the flame traveling into the fuel injector from the combustion chamber, which may damage the injector.

As a result, combustors that include microchannel injectors typically provide a filter upstream of the injectors for removing particles that may block the microchannels. It will be appreciated that this filter generally consists of a screen positioned over openings or "windows" formed through the cap assembly. Because of the small size of the particles that must be captured, the screen must have a fine mesh. This, of course, means that the screen has a large blockage ratio, i.e., the screen mesh blocks a large portion of the window area through which the air entering the combustor must flow. Blockage ratios of 50% or more are common in the screens that are used in these types of filtering applications. In addition, the windows within the cap assembly are limited in size. It will be appreciated that this forward area of the cap assembly provides the structural support to the aft areas of the cap assembly, as the cap assembly essentially is cantilevered in an aftwise direction from the connection it makes with the endcover.

The combination of these necessary design restraints, i.e., the fine mesh of the screen and the limited window area, result in an effective flow area that is restrictive given the supply of air that must pass therethrough. That is, the conventional screen/window configuration, which, as discussed in more detail below, generally includes a finely meshed screen placed directly over the windows) results in an effective flow area that causes a relatively high-pressure drop, which, of course, negatively affects engine performance. As a result there is a need for a more effective configuration to this area of the combustion. Such improvement should provide a larger effective flow area through the forward area of the cap assembly while also still maintaining the necessary structural support to the unit. In addition, a successful improvement should be cost-effective in production and installation, and be able to be retrofit into operating combustion turbines. The any such improvement should be flexible in operation. That is, the improvement should operate under a variety of conditions and with different sorts of fuel. Further, a filtering element that provided enhanced aerodynamic performance characteristics while being durable and cost-effective in implementation would satisfy a significant need within the field.

BRIEF DESCRIPTION OF THE INVENTION

The present application thus describes a combustor for a combustion turbine engine, the combustor that includes: a chamber defined by an outer wall and forming a channel between windows defined through the outer wall toward a forward end of the chamber and at least one fuel injector positioned toward an aft end of the chamber; a screen; and a standoff comprising a raised area on an outer surface of the outer wall near the periphery of the windows; wherein the screen extends over the windows and is supported by the standoff in a raised position in relation to the outer surface of the outer wall and the windows.

The present application further describes a combustor for a combustion turbine engine, the combustor comprising: a cylindrical cap assembly defined by an outer wall and forming a channel between windows defined through the outer wall toward a forward end of the cap assembly and at least one fuel injector positioned toward an aft end of the cap assembly; a screen, the screen being configured to extend over the windows such that, in operation, a supply of compressed air entering the cap assembly through the windows passes through the screen first; and a standoff comprising a raised area on an outer surface of the outer wall of the cap assembly; wherein the screen extends over the windows and is supported by the standoff in a raised outboard position in spaced relation to the outer surface of the outer wall and a reference plane, the reference plane comprising a smooth continuation of the outer surface of the outer wall if it were extended through the windows.

These and other features of the present application will become apparent upon review of the following detailed description of the preferred embodiments when taken in conjunction with the drawings and the appended claims.

BRIEF DESCRIPTION OF THE DRAWINGS

These and other aspects of this invention will be more completely understood and appreciated by careful study of the following more detailed description of exemplary embodiments of the invention taken in conjunction with the accompanying drawings, in which.

DETAILED DESCRIPTION OF THE INVENTION

As stated above and as follows, the present invention is presented in relation to one of its preferred usages in the combustion system of a combustion turbine engine. Hereinafter, the present invention will be primarily described in relation to this usage; however, this description is exemplary only and not intended to be limiting except where specifically made so. Those of ordinary skill in the art will appreciated that the usage of the present invention may be applied to several types of combustion turbine engines.

Figure 1:
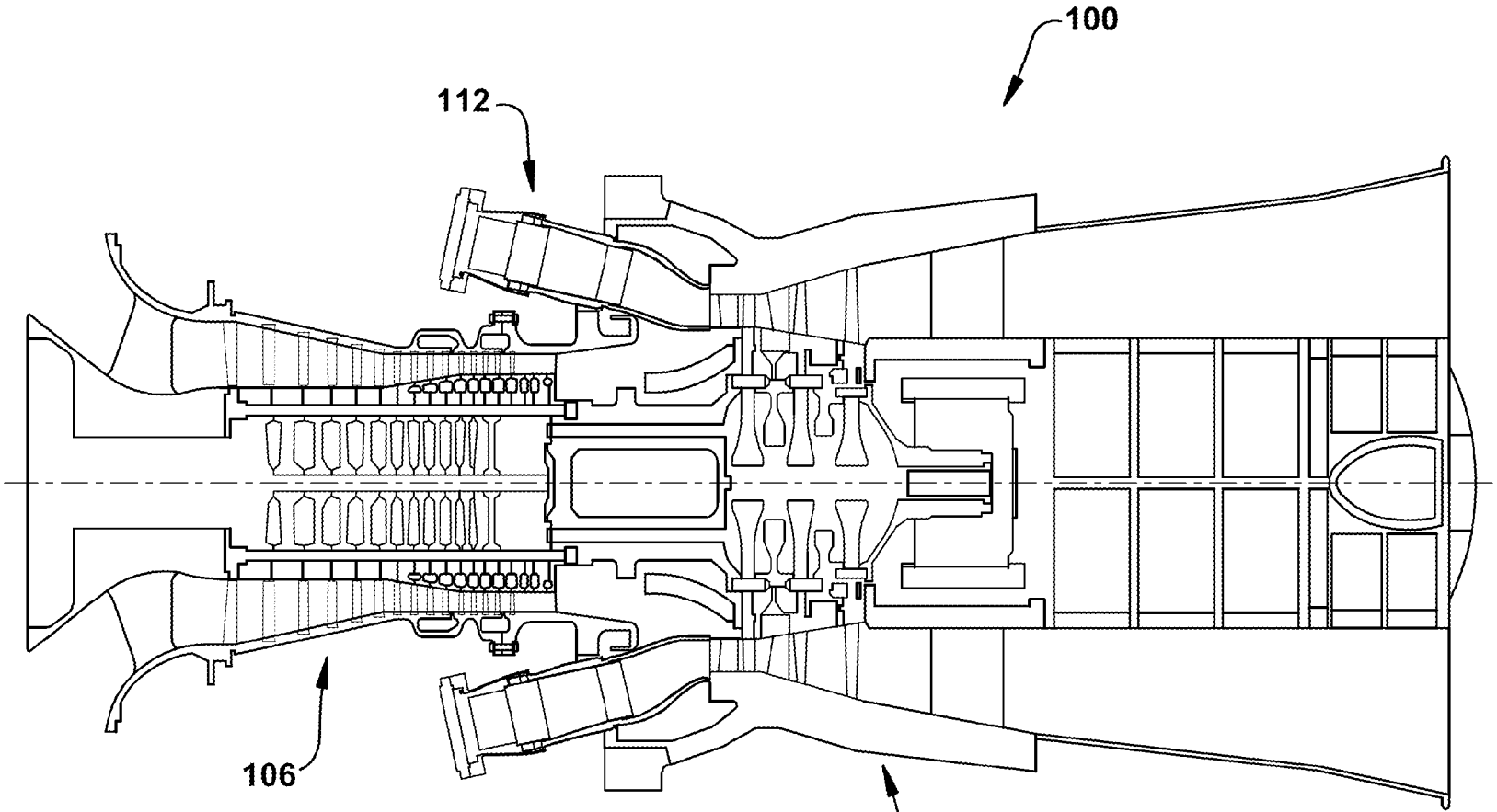
FIG. 1 is a schematic representation of an exemplary turbine engine in which embodiments of the present application may be used.

Referring now to the figures, FIG. 1 illustrates a schematic representation of a gas turbine engine 100 in which embodiments of the present invention may be employed. In general, gas turbine engines operate by extracting energy from a pressurized flow of hot gas that is produced by the combustion of a fuel in a stream of compressed air. As illustrated in FIG. 1, gas turbine engine 100 may be configured with an axial compressor 106 that is mechanically coupled by a common shaft or rotor to a downstream turbine section or turbine 110, and a combustion system 112, which, as shown, is a can combustor that is positioned between the compressor 106 and the turbine 110.

Figure 2:
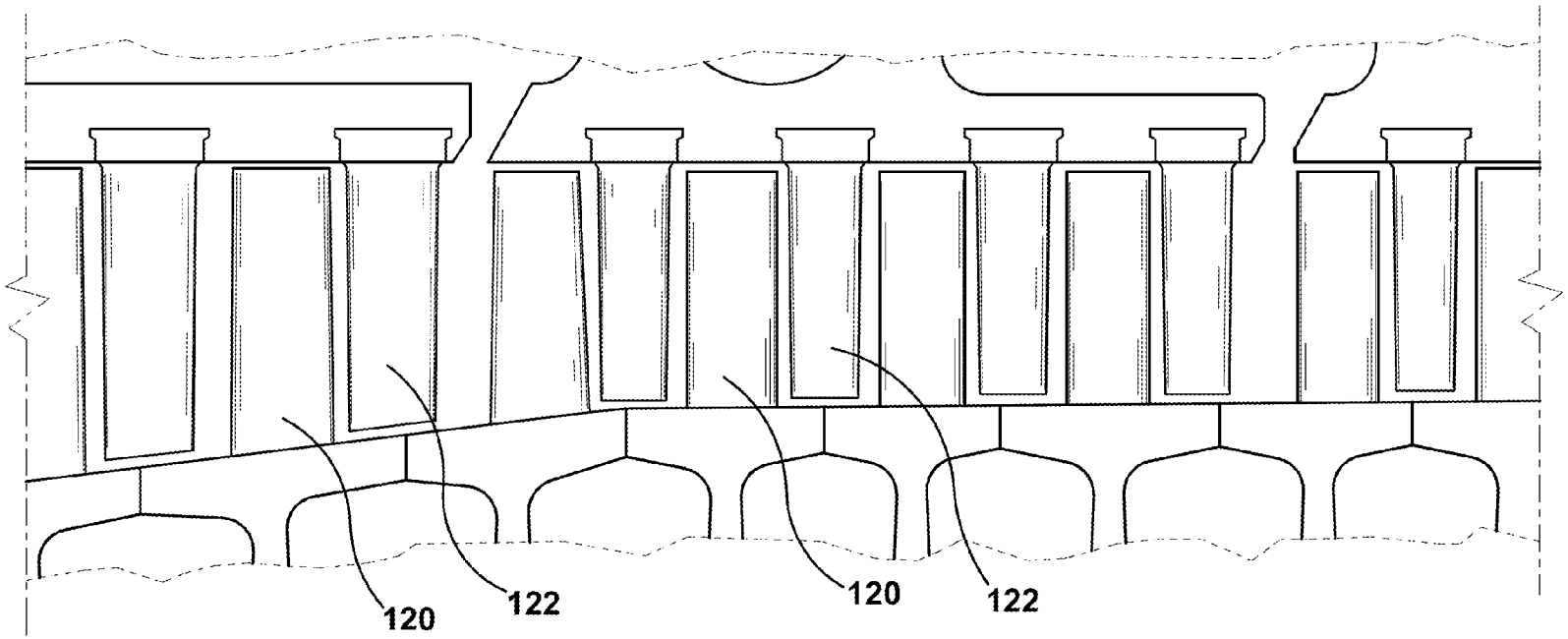
FIG. 2 is a sectional view of an exemplary compressor that may be used in the gas turbine

FIG. 2 illustrates a view of an axial compressor 106 that may be used in gas turbine engine 100. As shown, the compressor 106 may include a plurality of stages. Each stage may include a row of compressor rotor blades 120 followed by a row of compressor stator blades 122. Thus, a first stage may include a row of compressor rotor blades 120, which rotate about a central shaft, followed by a row of compressor stator blades 122, which remain stationary during operation. The compressor stator blades 122 generally are circumferentially spaced one from the other and fixed about the axis of rotation. The compressor rotor blades 120 are circumferentially spaced about the axis of the rotor and rotate about the shaft during operation. As one of ordinary skill in the art will appreciate, the compressor rotor blades 120 are configured such that, when spun about the shaft, they impart kinetic energy to the air or working fluid flowing through the compressor 106. As one of ordinary skill in the art will appreciate, the compressor 106 may have many other stages beyond the stages that are illustrated in FIG. 2. Each additional stage may include a plurality of circumferential spaced compressor rotor blades 120 followed by a plurality of circumferentially spaced compressor stator blades 122.

Figure 3:
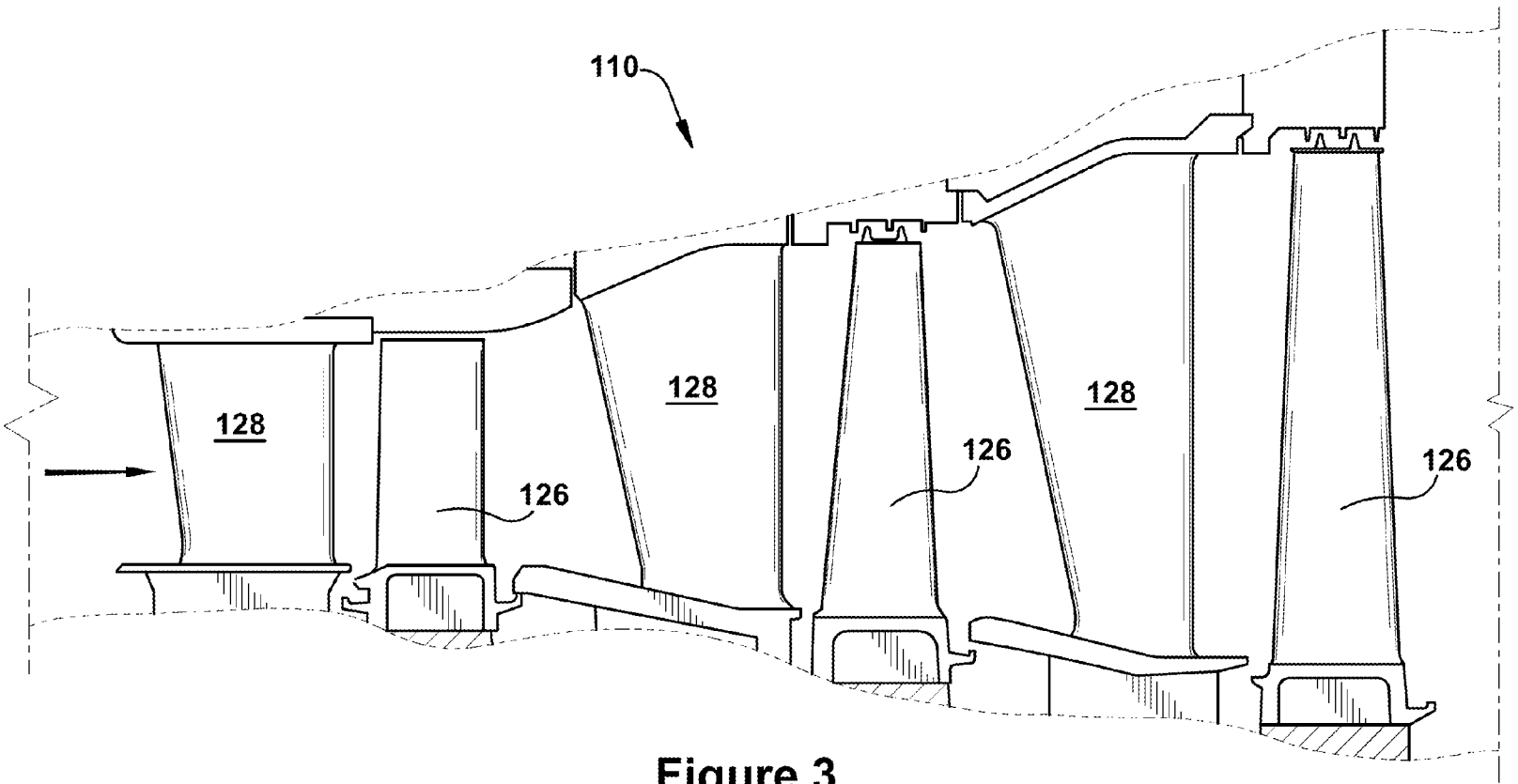
FIG. 3 is a sectional view of an exemplary turbine that may be used in the gas turbine engine of FIG. 1.

FIG. 3 illustrates a partial view of an exemplary turbine section or turbine 110 that may be used in a gas turbine engine 100. The turbine 110 may include a plurality of stages. Three exemplary stages are illustrated, but more or less stages may be present in the turbine 110. A first stage includes a plurality of turbine buckets or turbine rotor blades 126, which rotate about the shaft during operation, and a plurality of nozzles or turbine stator blades 128, which remain stationary during operation. The turbine stator blades 128 generally are circumferentially spaced one from the other and fixed about the axis of rotation. The turbine rotor blades 126 may be mounted on a turbine wheel (not shown) for rotation about the shaft (not shown). A second stage of the turbine 110 is also illustrated. The second stage similarly includes a plurality of circumferentially spaced turbine stator blades 128 followed by a plurality of circumferentially spaced turbine rotor blades 126, which are also mounted on a turbine wheel for rotation. A third stage also is illustrated, and similarly includes a plurality of circumferentially spaced turbine stator blades 128 and turbine rotor blades 126. It will be appreciated that the turbine stator blades 128 and turbine rotor blades 126 lie in the hot gas path of the turbine 110. The direction of flow of the hot gases through the hot gas path is indicated by the arrow. As one of ordinary skill in the art will appreciate, the turbine 110 may have many other stages beyond the stages that are illustrated in FIG. 3. Each additional stage may include a plurality of circumferential spaced turbine stator blades 128 followed by a plurality of circumferentially spaced turbine rotor blades 126.

A gas turbine engine of the nature described above may operate as follows. The rotation of compressor rotor blades 120 within the axial compressor 106 compresses a flow of air. In the combustor 112, as described in more detail below, energy is released when the compressed air is mixed with a fuel and ignited. The resulting flow of hot gases from the combustor 112 then may be directed over the turbine rotor blades 126, which may induce the rotation of the turbine rotor blades 126 about the shaft, thus transforming the energy of the hot flow of gases into the mechanical energy of the rotating shaft. The mechanical energy of the shaft may then be used to drive the rotation of the compressor rotor blades 120, such that the necessary supply of compressed air is produced, and also, for example, a generator to produce electricity.

Before proceeding further, it will be appreciated that in order to communicate clearly the present invention, it will become necessary to select terminology that refers to and describes certain parts or machine components of a turbine engine and related systems, particularly, the combustor system. Whenever possible, industry terminology will be used and employed in a manner consistent with its accepted meaning. However, it is meant that any such terminology be given a broad meaning and not narrowly construed such that the meaning intended herein and the scope of the appended claims is unreasonably restricted. Those of ordinary skill in the art will appreciate that often a particular component may be referred to using several different terms. In addition, what may be described herein as a single part may include and be referenced in another context as consisting of several component parts, or, what may be described herein as including multiple component parts may be fashioned into and, in some cases, referred to as a single part. As such, in understanding the scope of the invention described herein, attention should not only be paid to the terminology and description provided, but also to the structure, configuration, function, and/or usage of the component, as provided herein.

In addition, several descriptive terms may be used regularly herein, and it may be helpful to define these terms at this point. These terms and their definition given the usage herein are as follows. The term "rotor blade", without further specificity, is a reference to the rotating blades of either the compressor or the turbine, which include both compressor rotor blades and turbine rotor blades. The term "stator blade", without further specificity, is a reference the stationary blades of either the compressor or the turbine, which include both compressor stator blades and turbine stator blades. The term "blades" will be used herein to refer to either type of blade. Thus, without further specificity, the term "blades" is inclusive to all type of turbine engine blades, including compressor rotor blades, compressor stator blades, turbine rotor blades, and turbine stator blades.

Further, as used herein, "forward" and "aft" indicate a direction relative to the position of the compressor 106, which is said to be at the forward end of the turbine engine 100, and the turbine section 110, which is said to be at the aft end of the turbine engine 100. Accordingly, "forward" indicates a direction toward the compressor 106, whereas "aft" indicates a direction toward the turbine section 110. The terms "upstream" and "downstream" indicate a direction relative to the flow of working fluid through the turbine engine 100, and, respectively, when being used to describe direction within the compressor 106 or the turbine 110 are often used interchangeably with "forward" and "aft". However, in the combustor 112, it will be appreciated that working fluid flows both in a forward and aft direction. That is, the supply of compressed air from the compressor 106 generally enters the combustor 112 and, within a narrow annulus, flows in a forward direction (i.e., toward the compressor). This flow is then reversed as the compressed air is directed into the cap assembly and moves toward the fuel injectors of the combustor 106. As such, the terms "downstream" and "upstream", as used in conjunction with describing the operation of a combustor, refers to a direction of flow and is independent of whether the working fluid toward the compressor or turbine section of the engine.

The terms "radial", "axial" and "circumferential" may also be used herein because combustors typically have a cylindrical shape. The term "radial" refers to movement or position perpendicular to an axis and, in regard to a cylindrical combustor, which often does referred to as a "can" combustor, refers to movement or position perpendicular to the center axis of the cylindrical shape. Also, it is often required to described parts that are at differing radial positions with regard to the center axis. In this case, if a first component resides closer to the axis than a second component, it may be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis.

Figure 4:
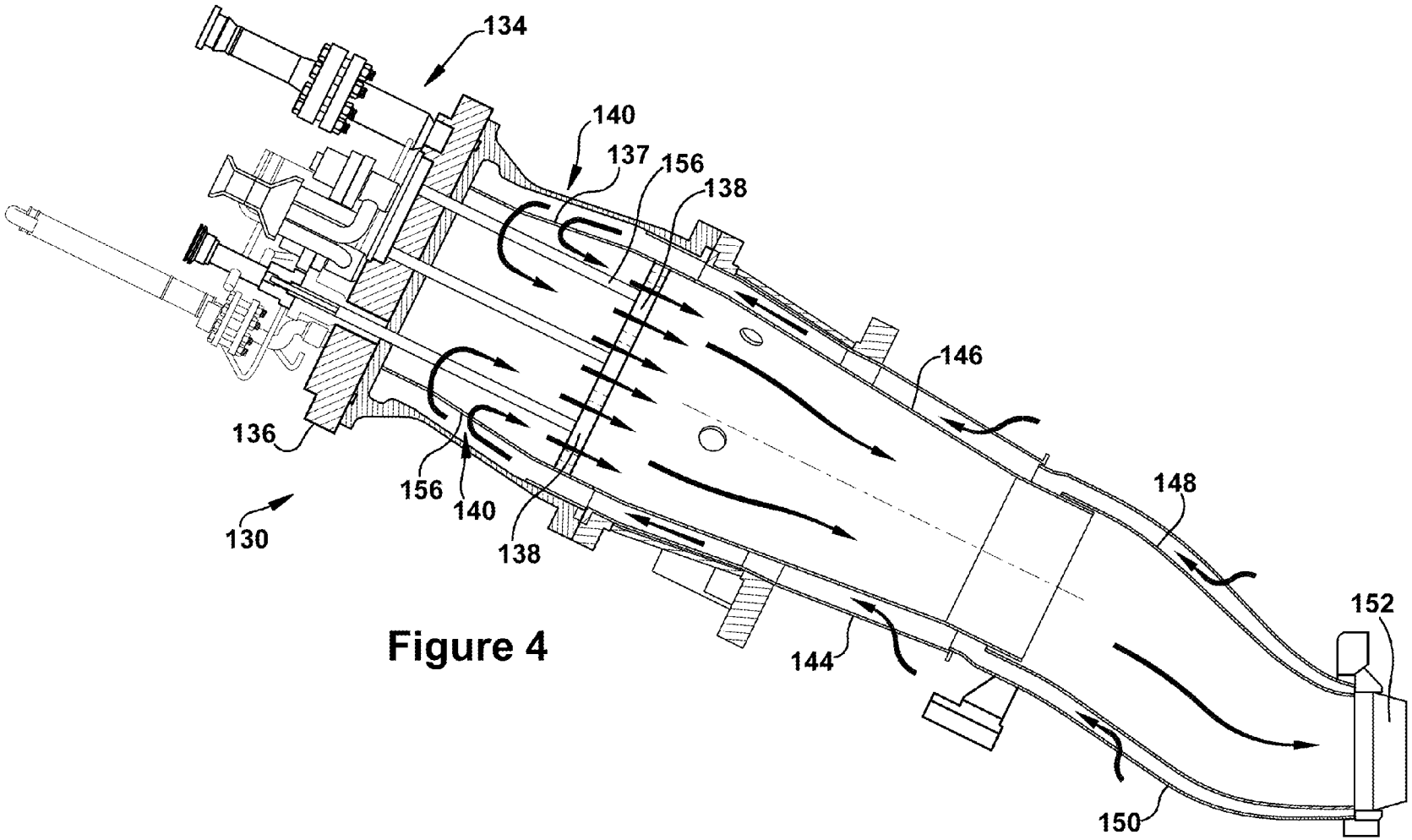
FIG. 4 is a sectional view of an exemplary combustor that may be used in the gas turbine engine of FIG. 1 and in which the present invention may be employed.
Figure 5:
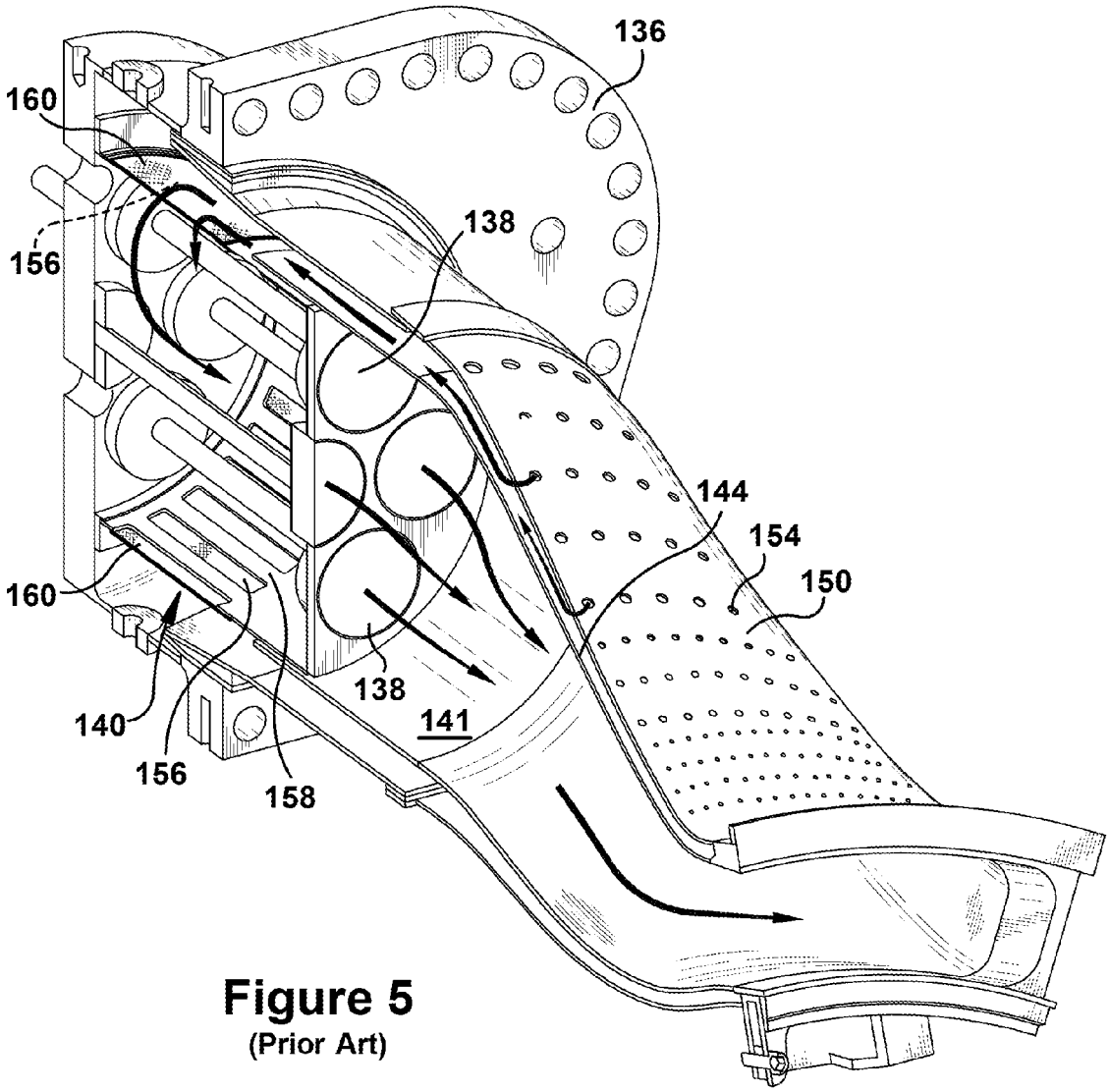
Figure 5 (Prior Art)
FIG. 5 is a perspective cutaway of an exemplary combustor in which the present invention may be employed.

FIGS. 4 and 5 illustrates an exemplary combustor 130 that may be used in a gas turbine engine and in which embodiments of the present invention may be used. As one of ordinary skill in the art will appreciate, the combustor 130 may include a headend 134, which generally includes the various manifolds that supply the necessary air and fuel to the combustor, and an end cover 136. A plurality of fuel lines 137 (update FIG. 4 to relocate end of leader) may extend through the end cover 136 to fuel nozzles or fuel injectors 138 that are positioned at the aft end of a forward case or cap assembly 140. It will be appreciated that the cap assembly 140 generally is cylindrical in shape and fixed at a forward end to the end cover 136.

In general, the fuel injectors 138 bring together a mixture of fuel and air for combustion. The fuel, for example, may be natural gas and the air may be compressed air (the flow of which is indicated in FIG. 4 by the several arrows) supplied from the compressor. As one of ordinary skill in the art will appreciate, downstream of the fuel injectors 138 is a combustion chamber 141 in which the combustion occurs. The combustion chamber 141 is generally defined by a liner 146, which is enclosed within a flow sleeve 144. Between the flow sleeve 144 and the liner 146 an annulus is formed. From the liner 146, a transition piece 148 transitions the flow from the circular cross section of the liner to an annular cross section as it travels downstream to the turbine section (not shown in FIG. 4). A transition piece impingement sleeve 150 (hereinafter "impingement sleeve 150") may enclose the transition piece 148, also creating an annulus between the impingement sleeve 150 and the transition piece 148. At the downstream end of the transition piece 148, a transition piece aft frame 152 may direct the flow of the working fluid toward the airfoils that are positioned in the first stage of the turbine 110. It will be appreciated that the flow sleeve 144 and the impingement sleeve 150 typically has impingement apertures (not shown in FIG. 4) formed therethrough which allow an impinged flow of compressed air from the compressor 106 to enter the cavities formed between the flow sleeve 144 and the liner 146 and between the impingement sleeve 150 and the transition piece 148. The flow of compressed air through the impingement apertures convectively cools the exterior surfaces of the liner 146 and the transition piece 148.

As shown in FIG. 5, the cap assembly 140 may include a series of openings or windows 156 through which the supply of compressed air enters the interior of the cap assembly 140. The windows 156, as shown, may be approximately rectangular in shape, with the rectangle having a pair of long sides aligned in the axial direction and a pair of short sides aligned in the circumferential direction. The windows 156 may be arranged parallel to each other, being spaced around the circumference of the cylindrical cap assembly. In this arrangement, it will be appreciated that struts 158 are defined between each of the windows 156, which support the cap assembly structure during operation. To prevent localized stress concentrations, the rectangular shape of the windows 156 may have rounded or filleted corners, as shown.

Figure 6:
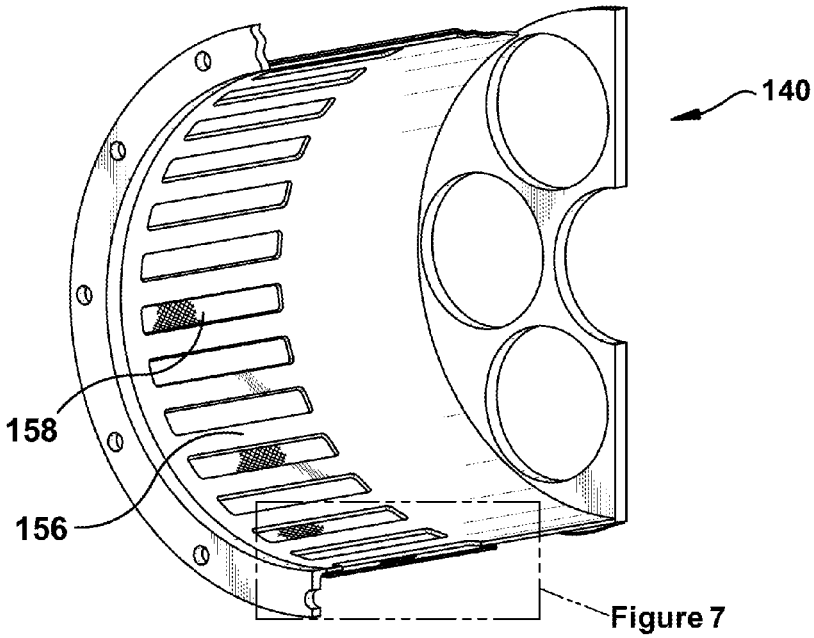
Figure 6 (Prior Art)
FIG. 6 is a perspective cutaway of the cap-assembly of the combustor of FIG. 5 that includes a screen assembly according to conventional design.
Figure 7:
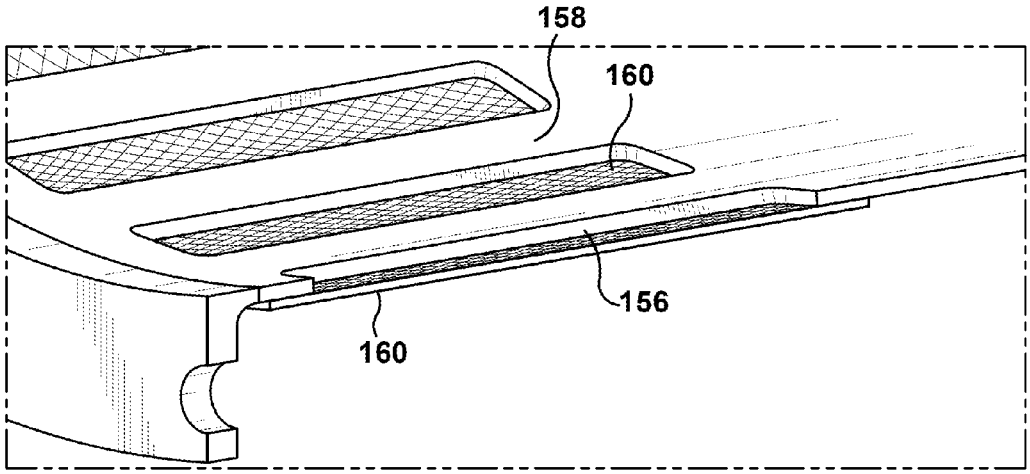
FIG. 7 is a close-up of the screen assembly of FIG. 6.

The fuel injector 138 may comprise a microchannel fuel injector. A microchannel fuel injector is so named because it introduces the fuel/air mixture through a plurality of small channels or microchannels. As used herein, "microchannels" include channels that have a cross-sectional flow area of 0.05 inches$^2$ or less. This type of channel configuration is effective at delivering a desired flow of pre-mixer fuel and air to the combustion chamber 141. As one of ordinary skill in the art will appreciate, this provides performance advantages in certain applications as well as allowing greater flexibility as to the type of fuel the engine is able to burn. However, this type of fuel injector generally is susceptible to blockage caused by small particles that may be contained in the stream of compressed air supplied by the compressor. The microchannels may become clogged by small particles that, in most conventional fuel injectors (i.e., those not employing microchannels), would have not been problematic. Such clogging generally results in poor engine performance and may cause significant damage to the fuel injector and the combustion system. As a result, combustors that include microchannel injectors typically provide a filter upstream of the injectors for removing potentially damaging particles. As shown in FIGS. 6 through 7, one type of filter that is prevalently used is a screen filter or screen 160, which is positioned over the windows 156. This type of filter is used because it performs well and is cost-effective to manufacture and install.

As one of ordinary skill in the art will readily appreciate, given the structural requirements of the cap assembly 140, the windows 156 are limited in size. This is due to the fact that the forward area of the cap assembly 140 must support the aft areas of the cap assembly 140, as the cap assembly 140 essentially is cantilevered in an aftwise direction from the connection it makes with the endcover 136. As such, generally, a series of struts 158 are maintained between neighboring windows 156, as shown in FIGS. 5 through 7, so that the structure is properly supported. Typically, the struts 158 must be designed with a significant circumferential width to provide the required support. While the size of the struts 158 may be reduced, the reduction generally comes at a high cost, either requiring the cap assembly 140 be constructed with more expensive materials, more complicated structural geometries, or more expensive manufacturing methods. As a result, typically, as shown in FIG. 6, the width of the struts 158 (i.e., the distance the struts 158 extend in the circumferential direction) is approximately the same as the width of the windows 156 (i.e., the distance the windows 156 extend in the circumferential direction). In addition, the length of the windows 156 (i.e., the distance the windows 156 extend in the axial direction) likewise is limited as well because of structural considerations.

The combination of these necessary design restraints, i.e., the fine mesh of the screen 160 and the limited area of the windows 156, results in an effective flow area through the window that is overly restrictive given the supply of air that must pass therethrough. In addition, conventional screen 160/window 156 configurations position the screen 160 essentially flush against the outer surface of the cap assembly windows 156. The outer surface of the cap assembly 156 supports the screen 160 (i.e., the screen 160 generally is stretched across the windows 156 and rests directly on and is supported by the outer surface of the cap assembly 140). The conventional screen arrangement, which is shown most clearly in FIG. 7, does nothing to alleviate the issue of an overly restrictive flow area. Accordingly, in usage, conventional assemblies often operate with a relatively high-pressure drop across the windows 156, which, of course, results in parasitic efficiency losses.

In use, the combustor 130 of FIGS. 4 through 7 generally operates as follows. A supply of compressed air from the compressor 106 may be directed into the annular cavity defined by the flow sleeve 144/liner 146 and/or the transition piece 148/impingement sleeve 150. The compressed air then travels in a generally forward direction (i.e., toward the compressor), cooling the outer surface of the liner 146 and the transition piece 148 along the way, until reaching the windows 156 formed through the cap assembly 140. The compressed air then flows through the windows 156 and is filtered by the screen 160 that is placed over the windows 156. Reversing flow direction, the compressed air enters the cap assembly 140 and flows towards the fuel injectors 138 that are positioned at the aft end of the cap assembly 140. The compressed air then flows into the microchannels of the fuel injectors 138. At the fuel injectors 138, generally, the supply of compressed air may be mixed with a supply of fuel, which is provided by a fuel manifold that connects to the fuel injectors 138 through the end cover 136 (via the fuel line 137). More specifically, the flow of fuel and the compressed air is mixed upon emerging from the aft side of the fuel injectors 138 and combusted within the combustion chamber 141. The combustion creates a flow of rapidly moving, extremely hot gases that is directed downstream through the liner 146 and transition piece 148 to the turbine 110, where the energy of the hot-gases is converted into the mechanical energy of rotating turbine blades.

Figure 8:
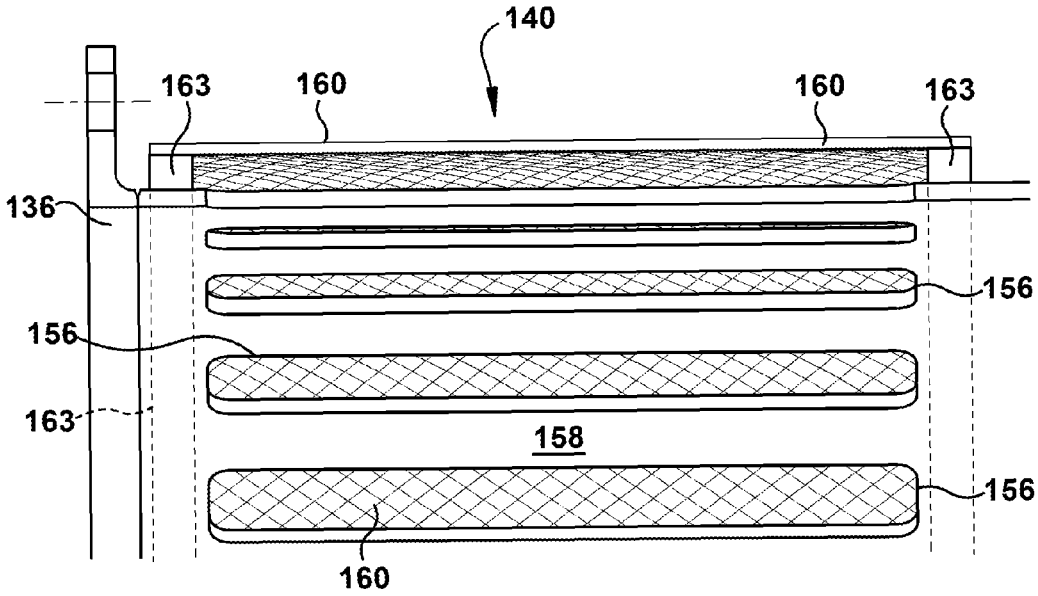
FIG. 8 is a perspective cutaway of a screen assembly with a standoff according to an exemplary embodiment of the present application.

FIG. 8 illustrates a cap assembly 140 that includes a screen 160 supported in spaced relation to the outer surface of the cap assembly 140 and the windows 156 by a standoff 163, which is in accordance to an exemplary embodiment of the present application. The standoff 163 comprises a structure or a plurality of structures that are raised from the level of the outer surface of the cap assembly 140 and, thereby, support the screen 160 in a raised position relative to the level of the outer surface of the cap assembly 140. (Note that the several figures illustrating standoffs 163 are not drawn to scale.) In one embodiment, as shown in FIG. 8, the standoff 163 may comprise rectangular strips that extend circumferentially around the outer surface of the outer wall of the cap assembly 140. The standoff 163 supports the screen 160 in a position that is raised from the outer surface of the cap assembly 140. In one preferred embodiment, the standoff 163, as shown, may include a forward standoff 163*a*, which is placed just forward of the forward end of the windows 156, and an aft standoff 163*b*, which is placed just aft of the aft end of the windows 156.

Figure 9:
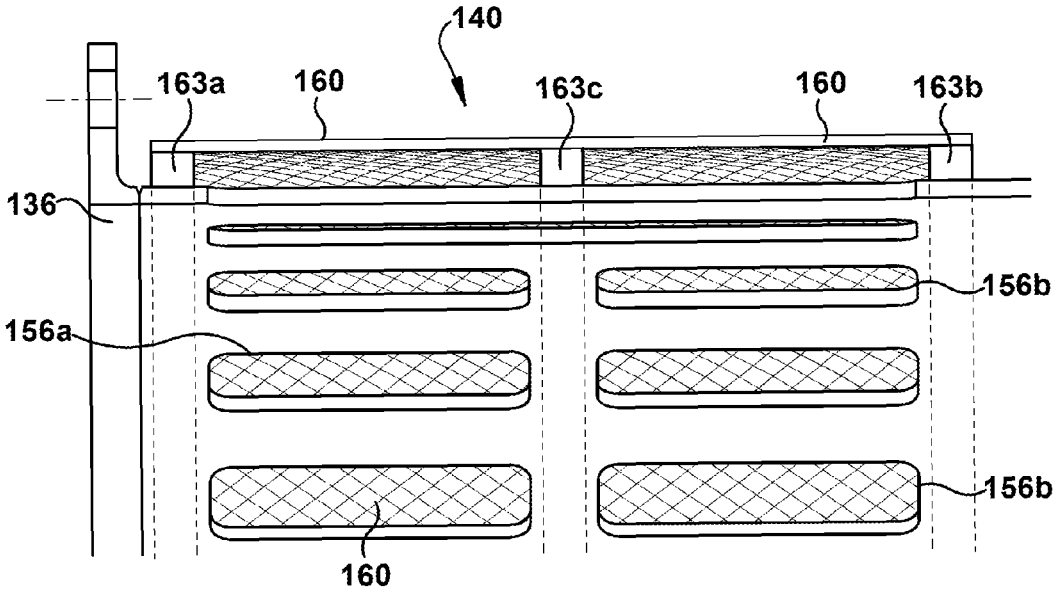
FIG. 9 is a perspective cutaway of a screen assembly with a standoff according to an alternative embodiment of the present application.

FIG. 9 illustrates a cap assembly 140 that includes alternatively configured windows 156 along with a standoff 163 according to an alternative embodiment of the present application. As shown, each window 156 is formed such that it is interrupted along its axial length, thereby forming a forward window 156*a* and an aft window 156*b* at each circumferential location. It will be appreciated that this will provide structural benefits to the cap assembly 140, which may be necessary in certain applications. With the windows 156 formed in this manner, a center standoff 163*c* may be added between the forward window 156*a* and the aft window 156*b*, as depicted. It will be appreciated that having this additional central standoff strip 163*c* provides additional support to the screen 160, which may be needed depending on the stiffness of this screen 160, the axial length of the windows 156 or other relevant criteria.

Figure 10:
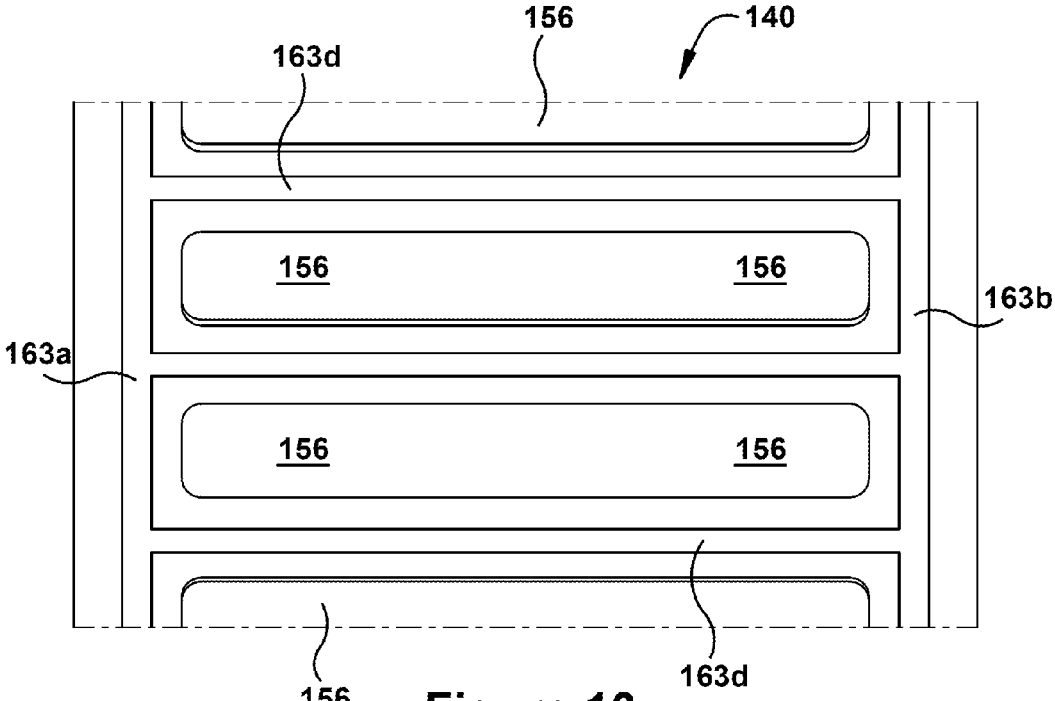
FIG. 10 is a side view of a standoff as it may be positioned on the outer surface of the cap assembly according to an alternative embodiment of the present application.
Figure 11:
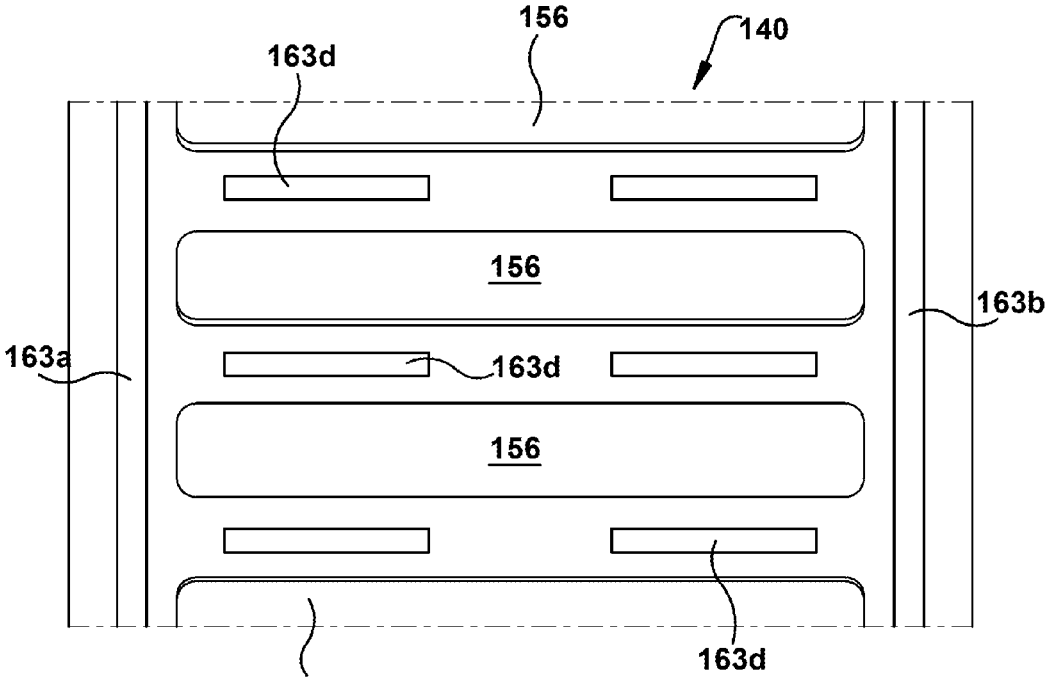
FIG. 11 is a side view of a standoff as it may be positioned on the outer surface of the cap assembly according to an alternative embodiment of the present application.

FIGS. 10 and 11 provide side views of standoffs 163 as they may be positioned on the outer surface of the cap assembly 140 according to alternative embodiments of the present application. As shown in FIG. 10, in one alternative embodiment, the standoff 163 may include axially extending standoff strips 163*d* that are positioned on the struts 158. These axial standoffs 163*d* may extend from the forward standoff 163*a* to the aft standoff 163*b*. This configuration provides additional support to the screen 160, which, again, may be necessary depending on the application, the type of screen 160, or other relevant criteria. It will also be appreciated that the axial standoff 163*d* may be positioned at the approximate center of the struts 158. This positioning provides or creates a buffer 165 between the edge of the standoff 163 and the edge of the window 156. As discussed in more detail below, this buffer 165 enhances the performance of the standoff 163 by increasing the area through which air may enter the space between the screen 160 and the cap assembly 140 (and thus the amount of air that may flow into the window 156). FIG. 11 illustrates another alternative embodiment. In this instance, the axial extending standoff 163*d* does not extend continuously from the forward standoff 163*a* to the aft standoff 163*b*. Instead, the axially extending standoff 163*d* extends intermittently. It will be appreciated that this type of embodiment provides additional support to the screen 160, while, as described in more detail below, providing an increased area for flow into the space between the screen 160 and cap assembly 140 to occur. It will be appreciated that other configurations than the exemplary ones shown in FIGS. 10 and 11 are possible.

Figure 12:
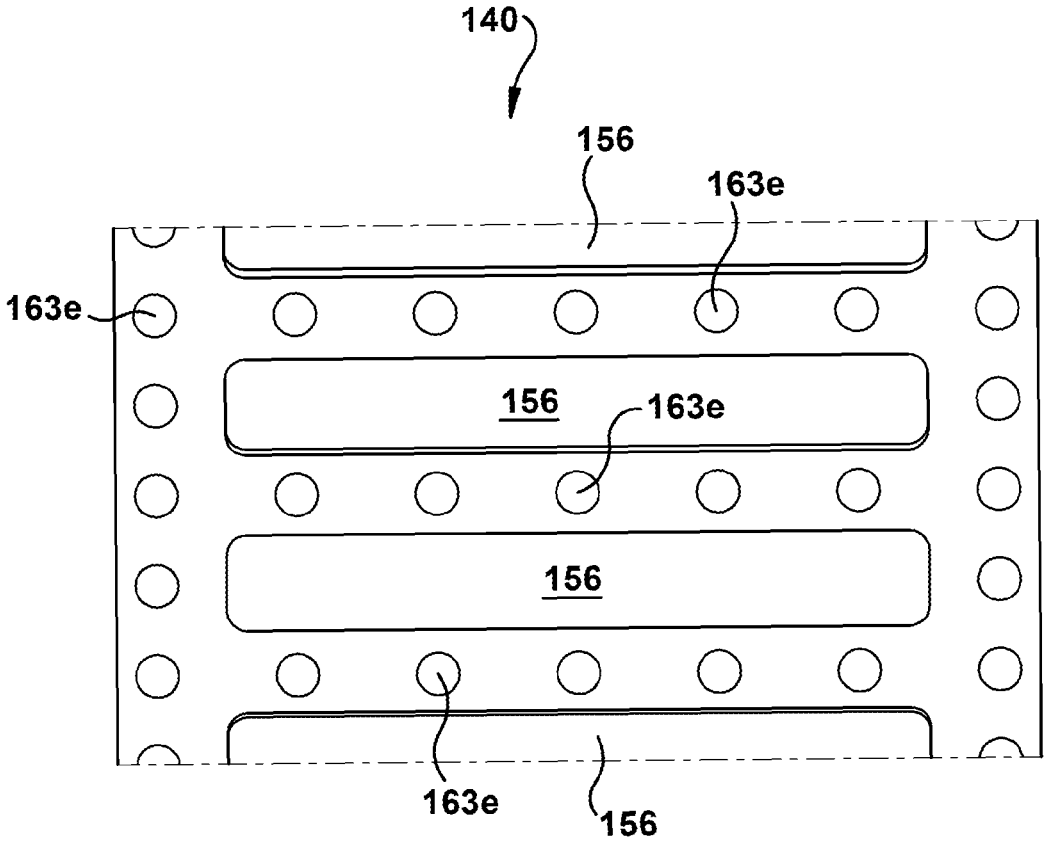
FIG. 12 is a side view of discrete standoffs as they may be positioned on the outer surface of the cap assembly according to an alternative embodiment of the present application.
Figure 13:
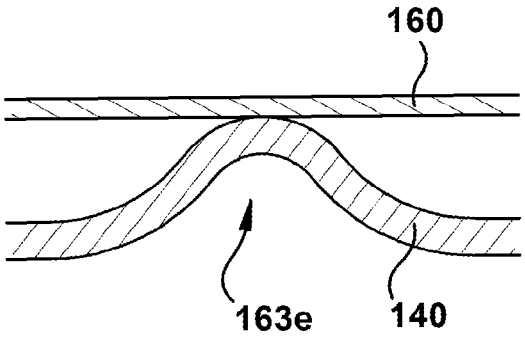
FIG. 13 is a section view of a discrete standoff according to an exemplary embodiment of the present application.
Figure 14:
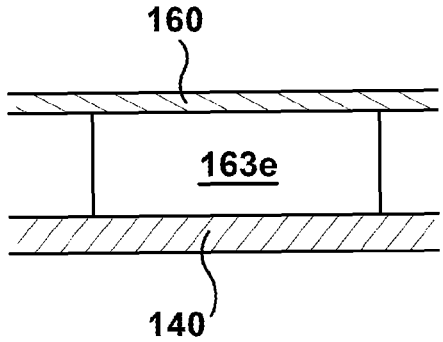
FIG. 14 is a section view of a discrete standoff according to an alternative embodiment of the present application.

FIGS. 12 and 13 provide an alternative embodiment of a standoff according to the present application. FIG. 12 is a side view of discrete standoffs 163*e* as they may be employed and positioned on the outer surface of the cap assembly 140 in this type of embodiment. FIG. 13 is a section view of a discrete standoff 163 according to a preferred embodiment, while FIG. 14 is a section view of a discrete standoff according to an alternate preferred embodiment. As shown, unlike the strips of the embodiments described above, discrete standoffs 163*e* are smaller in size, more numerous, and separated from each other. As shown, discrete standoffs 163*e* may be circular in shape, when viewed from the side (i.e., as shown in FIG. 12). Other shapes are also possible. As shown in FIGS. 13 and 14, the discrete standoffs 163*e* may be take different cross-sectional shapes. FIG. 13 illustrates a dimpled discrete standoff 163*e*, which is rounded in shape and has a peaked or dimpled profile with an area of greatest height toward its approximate center. FIG. 14 illustrates a cylindrically shaped discrete standoff 163*e*, which, it will be appreciated, has a rectangular profile and a constant height.

Figure 15:
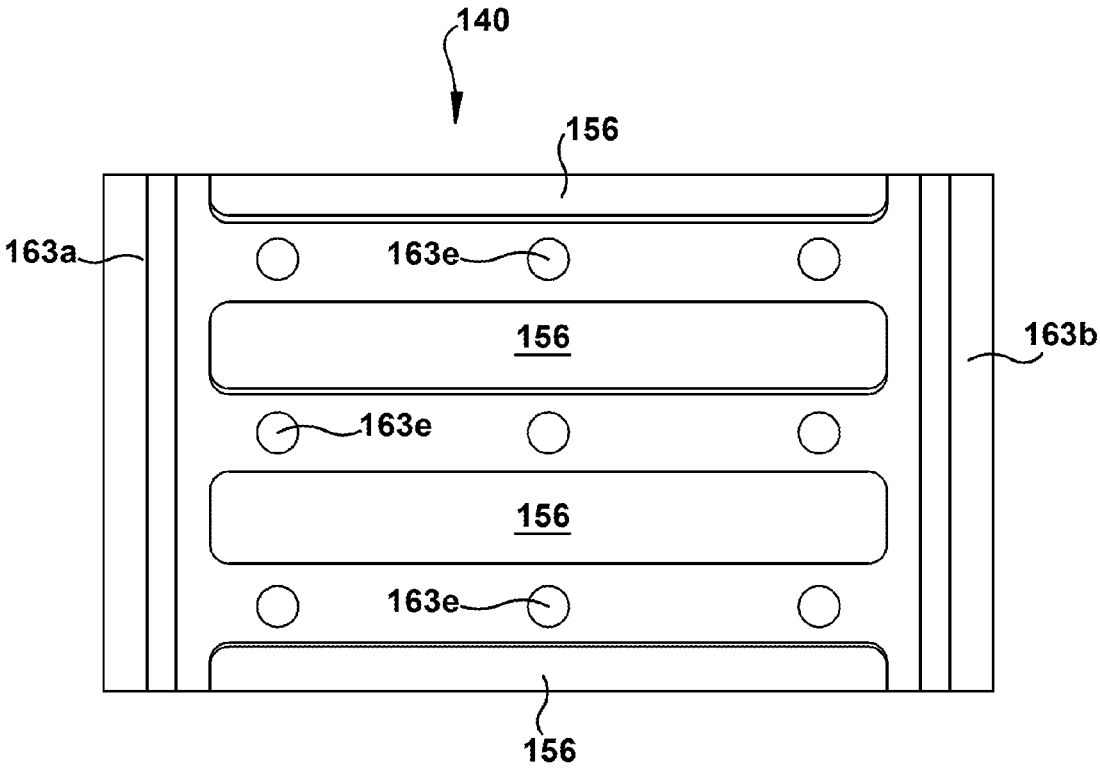
FIG. 15 is a side view of standoff strips and discrete standoffs as they may be combined on the outer surface of the cap assembly according to an alternative embodiment of the present application.

It will be appreciated that the discrete dimpled standoff 163*e* of FIG. 13 may have certain advantages in terms of low-cost construction and durability. For example, the dimpled standoffs 163*e* may be formed by deforming the inner surface of a conventional cap assembly 140 per conventional methods. That is, as one of ordinary skill in the art will appreciate, the dimpled standoffs 163*e* may be formed by applying a sufficient outward force to point locations at predetermined locations along inner surface of the cap assembly 140. In this manner, the standoffs 163*e* may be an integrally formed part of the cap assembly 140, which would substantially nullify any dislodgement risk that accompanies separate and attached pieces. In some embodiments, though not shown, the dimpled standoffs 163*e* may be formed by deforming the inner surface of the cap assembly 140 while also forming an aperture through the outer wall in the cap assembly 140. The aperture would be positioned in the approximate center of the dimpled standoff 163*e* given this type of construction. It will be appreciated that this method may be used to provide the raised dimple (which is necessary for the function of the standoffs 163) on the outer surface of the cap assembly 140, while also providing another entry point for the compressed air entering the cap assembly 140. As shown in FIG. 15, in some embodiments, a combination of standoff strips 163 and discrete standoffs 163*e* may be used together. In one embodiment, as depicted in FIG. 15, the circumferential standoff strips 163*a*/163*b* may be used to enclose the windows within the screen 160 and the discrete standoffs 163*e* may be used to provide support to the screen 160 between the two standoff strips.

As shown in the several figures, the standoff 163 is configured such that a buffer is created between the edge of the window 156 and the edge of the standoff 163. That is, space is maintained along the outer surface of the cap assembly 140 between the window 156 and the standoffs 163. In usage, this buffer allows each of the windows 156 to collect flow that has already passed through the screen 160 from a footprint that is significantly larger than the footprint of the window 156. It will be appreciated that this is not possible if the screen 160 is laid flat against the outer surface of the cap assembly 140. More particularly, the standoffs 163 support the screen 160 at an elevated position, which increases the area of screen 160 that may accept the inflow of compressed air. Once inside the screen 160, the compressed air may then flow through the unobstructed opening of the window 156. In this manner, it will be appreciated that the standoffs 163 may be used to alleviate the significant blockage caused by the fine mesh of the screen 160 by increasing the area that the air can flow though the screen. This results in a lower parasitic pressure drop, while still allowing the struts 158 to have a width that adequately supports the structure.

In general, the height of the standoffs 163 (i.e., the distance the standoff 163 extends from the outer surface of the cap assembly 140) may vary depending on certain criteria. In some embodiments, the height of the standoffs 163 is designed such that a necessary airflow into the windows 156 is achieved given the requirements of the turbine engine, size of the windows 156, the mesh size of the screen 160, the placement of the standoffs 163, and/or the size of the buffer area maintain around the windows 156. As a general rule, the height of the standoffs 163 (which, as stated, substantially determines the height the screen 160 is maintained above the outer surface of the cap assembly 140) is designed such that the flow space created between the screen 160 and the outer surface of the cap assembly 140 is sufficient to carry the flow passing through the area of screen 160 that resides over the buffer areas to the windows 156. In some preferred embodiments, the standoff 163 comprises a height of between approximately 0.032 and 0.188 inches. In more preferred embodiments, the standoff 163 comprises a height of between approximately 0.062 and 0.125 inches. In some embodiments, the standoff 163 comprises a uniform or constant height. However, it will be appreciated that the standoff 163 may also be designed to have a varying or non-uniform height. It will further be appreciated that the present invention provides advantages in that it may used to cost-effectively retrofit combustors having a conventionally design.

Another feature of the present application is the layering of a plurality of screens 160 to provide performance enhancing flow characteristics into the cap assembly 140. It will be appreciated that, in general, the velocity of air flowing into the windows 156 varies depending on the axial location of entry. Compressed air that enters the window 156 at an aft position, i.e., at a position near the aft end of the window 156, tends to have a greater velocity and, in making the necessary 180° turn toward the fuel injectors 138 upon entering the cap assembly 140, forms a wide turn arc that takes some of the flow deep into the interior areas of the cap assembly 140, thereby creating a relatively large separation bubble. Whereas, compressed air that enters the window 156 at a more forward position, i.e., at a position near the forward end of the window 156, tends to have a reduced velocity and, in making the necessary 180° turn toward the fuel injectors 138 upon entering the cap assembly 140, forms a narrower turn arc such that much of the flow remains along the periphery of the cap assembly 140. Upon this flow reversal and the movement of the air toward the fuel injectors, it will be appreciated that the air of slower velocity and narrower turn radius collides with the air of faster velocity and wider turn radius. This common resulting flow pattern causes additional resistance, turbulent flow, and aerodynamic losses. For example, in this two-layer area where the flows collide, the velocity of the air exiting the portion of the window closest to the fuel nozzles is reduced.

Pursuant to embodiments of the present invention, these aerodynamic losses may be avoided by providing a multilayered screen filter (i.e., a screen filter that includes at least two stacked layers of screen in at least a portion of the filter). In some embodiments, the multilayered screen filter includes at least two layers of screen 160 toward the aft end of the windows 156, while leaving the forward end of the windows 156 covered by only one layer of screen 160. Other configurations are possible, as discussed in more detail below. In other embodiments, additional layers of screens 160 may be provided (i.e., layers in addition to the two aft layers/one forward layer of screen 160). In these cases, it will be appreciated that, relative to the aft end of the window 156, the forward end of the window 156 will be covered by a reduced number of screen layers 160. During operation, the additional layers of screens 160 increases the variation in the velocity of the compressed air entering the windows 156 along the axial length of the window 156 as well as the variation of the turn radius of that the flow makes in reversing flow direction. More specifically, the additional layers of screen 160 that cover the aft end of the windows 156 provide more blockage or resistance and, thereby, slow the flow of compressed air through the aft region of the windows 156, which decreases the arc that the flow makes in turning toward the fuel injectors 138. In this manner, the flow of compressed air into the aft section of the window 156 and the flow of compressed air into the forward section of the window 156 may be homogenized and, thereby, brought together without suffering the attendant aerodynamic losses described above.

Figure 16:
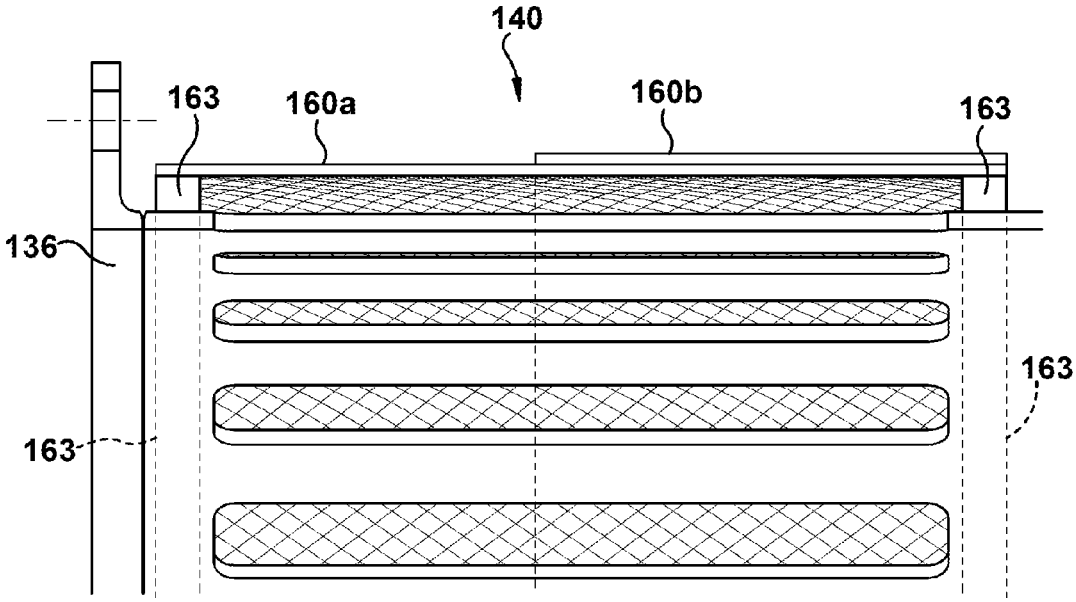
FIG. 16 is a perspective cutaway of a layered screen assembly with a standoff according to an alternative embodiment of the present application.

As shown in FIG. 16, two layers of screen 160 may be used pursuant to an exemplary embodiment of the present invention. A first screen 160*a* may be positioned in much the same way as the screens 164 were positioned in the embodiments discussed above. That is, the first screen 160*a* may extend from a forward standoff 163*a* to an aft standoff 163*b*. A second screen 160*b* may be placed over the first screen 160*a*, as shown. In one preferred embodiment, the second screen 160*b* extends from the aft standoff 163*b* to an axial location at the approximate center of the window 156. It will be appreciated that, in alternative embodiments (not shown), the second screen 160*b* may occupy the inboard position, while the first screen 160*a* occupies the outboard position.

Figure 17:
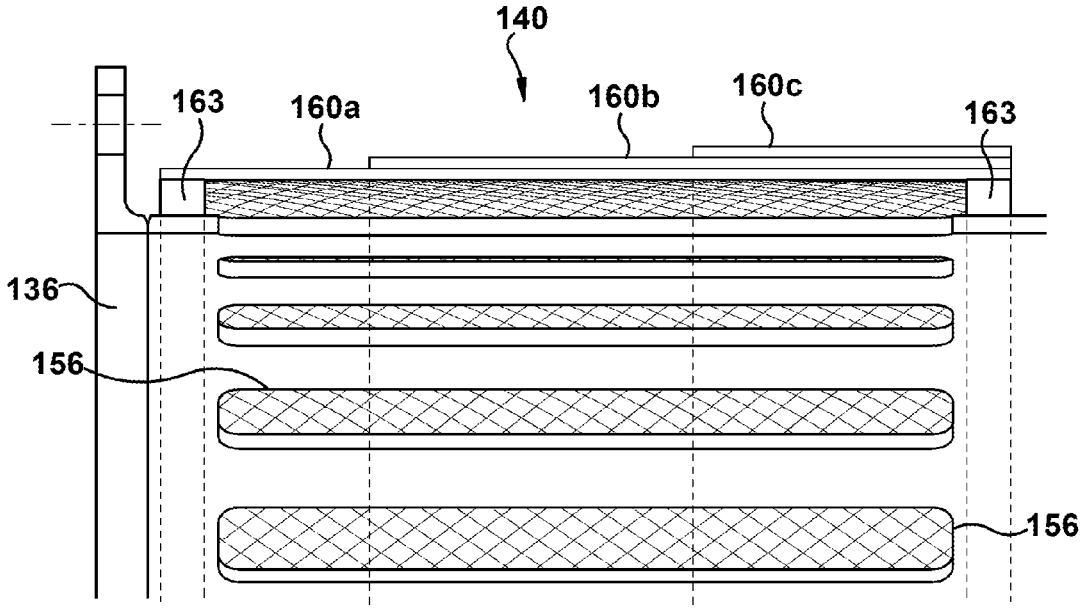
FIG. 17 is a perspective cutaway of a layered screen assembly with a standoff according to an alternative embodiment of the present application.

FIG. 17 illustrates an alternative embodiment in which three screen layers are employed. A first screen 160*a* may extend from the forward standoff 163*a* to the aft standoff 163*b*. A second screen 160*b* may be placed over the first screen 160*a*, as shown, and extend from the aft standoff 163*b* to cover approximately ⅔rds of the axial length of the window 156. A third screen 160*c* may be placed over the second screen 160*b*, as shown, and extend from the aft standoff 163*b* to cover approximately ⅓rds of the axial length of the window 156.

Figure 18:
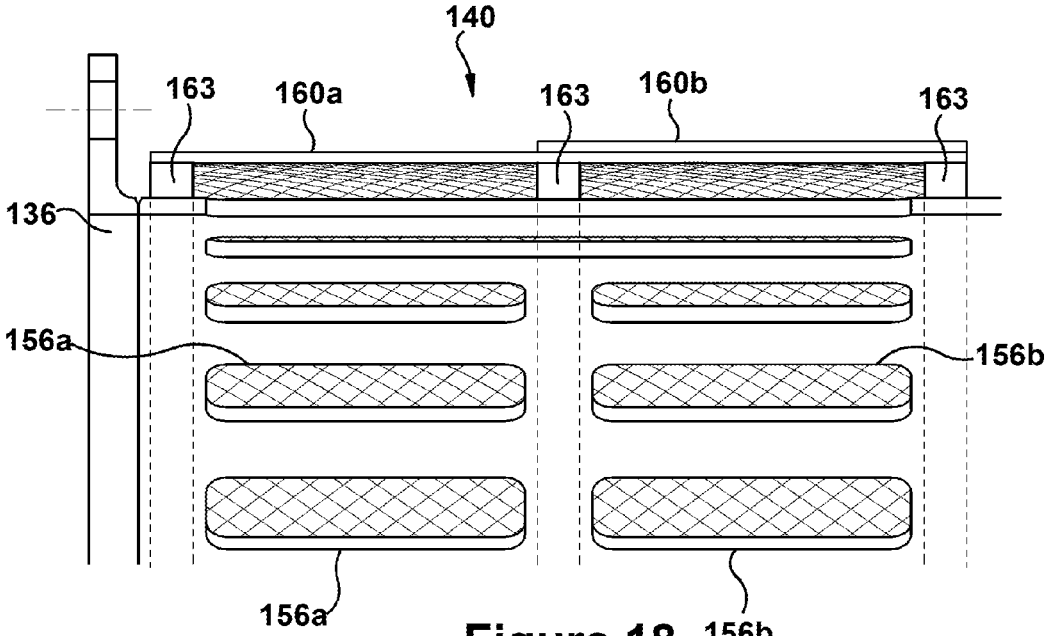
FIG. 18 is a perspective cutaway of a layered screen assembly with a standoff according to an alternative embodiment of the present application.

FIG. 18 illustrates an alternative embodiment in which two screen layers are employed with a window configuration in which the windows 156 includes an aft window 156*b* and a forward window 156*a*. As shown, a first screen 160*a* may extend from the forward standoff 163*a* to the aft standoff 163*b*. A second screen 160*b* may be placed over the first screen 160*a*, as shown, and extend from the aft standoff 163*b* to a standoff 163 positioned between the windows 156.

Figure 19:
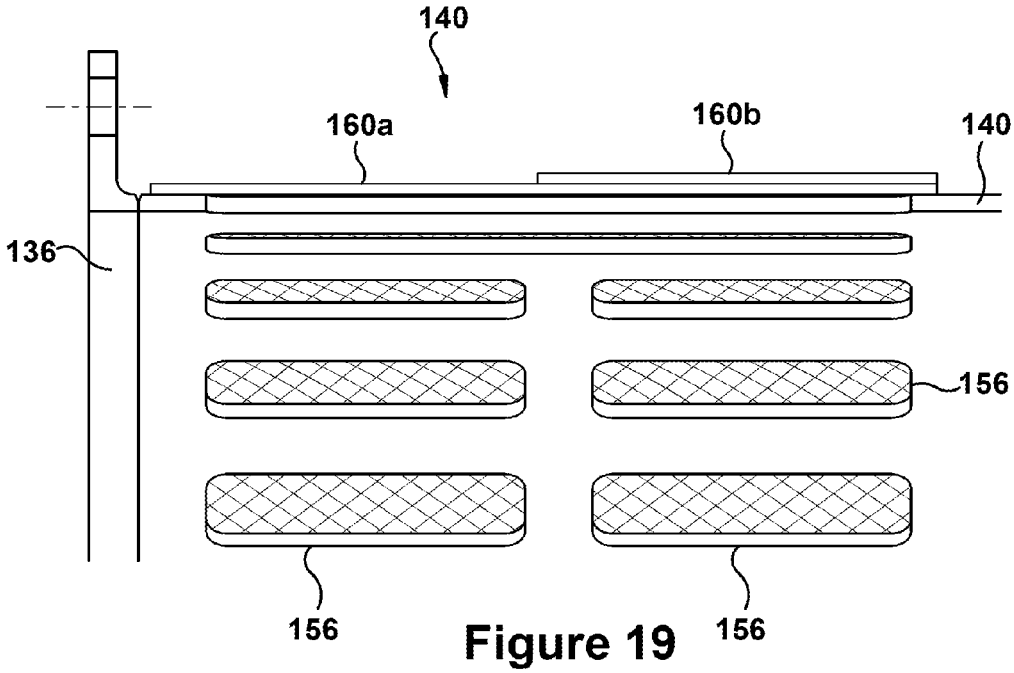
FIG. 19 is a perspective cutaway of a layered screen assembly in an application without a standoff according to an alternative embodiment of the present application.

FIG. 19 illustrates an embodiment that includes layered screens 160 without standoffs 163. It will be appreciated by those of ordinary skill in the art that the use of layered screens 160 provides performance enhancement independent of the use of standoffs 163. That is, the performance benefits associated with the reduction of aerodynamic losses may be achieved whether or not standoffs 163 according to the present application are also employed.

The screen 160 generally is constructed with a suitable material given the environment within the combustor. For example, the screen may be constructed with stainless steel, nickel based wire, perforated sheet stock, or any other suitable materials. In general, because of the small size of the particles that must be captured, the screen 160 must have a very fine mesh. In preferred embodiments, the mesh size of the screen have openings of 0.015 inches$^2$ or less. More preferably, the mesh size of the screen according to the present application is within a range of approximately 0.0006 and 0.015 inches$^2$. Ideally, the mesh size of the screen is within a range of approximately 0.0009 and 0.0025 inches$^2$. In other embodiments according to the present application, the mesh size may be configured in relation to the size of the smallest openings within the microchannel fuel injector 138. In these cases, generally, the mesh size may be configured such that it is less than the small openings through the fuel injector. As stated, the fineness of the mesh size, results in the screen 160 blocking a substantial portion of the windows 156, i.e., the fine mesh of the screen blocks a large portion of the window area through which the air entering the combustor must flow. Blockage ratios of 50% or more are common in the screens 160 that are used in these types of filtering applications. In some embodiments, standoffs 163 prove effective when used in conjunction with screens 160 that have blockage ratios of at least 40%. In preferred embodiments, standoffs 163 prove effective when used in conjunction with screens 160 that have blockage ratios of at least 50%. The screens 160 may be attached to the outer surface of the cap assembly 140 or to the standoffs under 63 or to another layer of screen 160 pursuant to conventional methods. Attachment methods may include, for example: spot welding, brazing, mechanical attachment, or other similar techniques.

The standoffs 163 may be constructed with materials that are able to withstand the harsh conditions within the combustor. In certain preferred embodiments, the standoffs 163 are constructed with the following materials: stainless steel, carbon steel, or nickel based alloys. Other materials are also possible. The standoffs 163 may be attached to the outer surface of the cap assembly 140 or to the screens 160 pursuant to conventional methods. Attachment methods may include, for example: brazing, welding, mechanical attachment, or other similar techniques.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A combustor for a combustion turbine engine, the combustor comprising:

a chamber defined by an outer wall and forming a channel between windows defined through the outer wall toward a forward end of the chamber and at least one fuel injector positioned toward an aft end of the chamber;

a screen filter; and a standoff comprising a raised area on an outer surface of the outer wall near the periphery of the windows and a forward standoff that is positioned just forward of the forward end of the windows;

wherein the screen filter extends over the windows and is supported by the standoff in a raised position in relation to the outer surface of the outer wall and the windows.

2. The combustor in accordance with claim 1, wherein:

the chamber and the outer wall comprise a cylindrical cap assembly;

the screen filter is configured such that, in operation, a supply of compressed air entering the chamber through the windows passes through the screen filter first;

in relation to the outer surface of the outer wall, the raised position comprises a position outboard of the outer surface of the outer wall; and in relation to the windows, the raised position comprises a position outboard of a reference plane, wherein the reference plane comprises a smooth continuation of the contour of the outer surface of the outer wall that surrounds the windows.

3. The combustor in accordance with claim 2, wherein:

the standoff includes a radial height that comprises the distance the standoff extends in the radial direction from the outer surface of the outer wall;

the standoff is configured with a constant radial height; the screen filter resides in spaced relation to the outer surface of the outer wall; and the spaced relation corresponds to the constant radial height of the standoff.

4. The combustor in accordance with claim 3, wherein:

the windows comprises a rectangular shape having a pair of long sides aligned in the axial direction and a pair of short sides aligned in the circumferential direction;

the windows are evenly spaced around the circumference of the cylindrical cap assembly; and struts are defined between each pair of neighboring windows, the struts and windows having a width that comprises the distance each extends circumferentially and a length that comprises the distance each extends axially.

5. The combustor in accordance with claim 2, wherein:

the cap assembly extends aftwise from a first connection made with an endcover to a second connection made with a combustion liner;

the fuel injector comprises a microchannel fuel injector; and the screen filter comprises a predetermined mesh size that corresponds in size to the size of the channels in the microchannel fuel injector.

6. The combustor in accordance with claim 3, wherein the forward standoff comprising a strip that extends continuously around the circumference of the cylindrical cap assembly;

the standoff comprises an aft standoff that is positioned just aft of the aft end of the windows, the aft standoff comprising a strip that extends continuously around the circumference of the cylindrical cap assembly; and the screen filter extends around the circumference from the forward standoff to the aft standoff.

7. The combustor in accordance with claim 6, wherein the windows are formed such that each is interrupted along its axial length by a bisecting section of outer wall such that a forward window and an aft window is formed; and the standoff comprises a center standoff that is positioned between the forward window and the aft window, the center standoff comprising a strip that extends circumferentially around the bisecting sections of the outer wall.

8. The combustor in accordance with claim 6, wherein the standoff comprises axial standoffs, the axial standoffs comprising strips that are positioned on the struts and extend continuously in an axial direction from the forward standoff to the aft standoff.

9. The combustor in accordance with claim 6, wherein the standoff comprises axial standoffs, the axial standoffs comprising strips that are positioned on the struts and extend intermittently in an axial direction from the forward standoff to the aft standoff.

10. The combustor in accordance with claim 6, wherein the standoffs comprise a plurality of discrete standoffs positioned on the struts between the forward standoff and the aft standoff.

11. The combustor in accordance with claim 2, wherein the standoffs comprise a plurality of discrete standoffs.

12. The combustor in accordance with claim 11, wherein the discrete standoffs comprise a circular shape and a dimpled profile; and wherein the discrete standoffs are integrally formed with the outer wall.

13. The combustor in accordance with claim 11, wherein the discrete standoffs comprise a circular shape and a rectangular profile.

14. The combustor in accordance with claim 3, further comprising a buffer;

the buffer comprising an area on the outer surface of the outer wall between the edge of one of the windows and the edge of the surrounding standoff.

15. The combustor in accordance with claim 14, wherein the buffer comprises a predetermined size; and wherein the predetermined size of the buffer and the constant radial height of the standoff are configured based on the mesh size of the screen and a preferred level of flow in the chamber through the windows during operation.

16. The combustor in accordance with claim 14, wherein the standoff comprises a height of at least 0.032 inches.

17. The combustor in accordance with claim 14, wherein the standoff comprises a height of between approximately 0.062 and 0.125 inches.

18. The combustor in accordance with claim 14, wherein the screen filter comprises a predetermined mesh size, the predetermined mesh size comprising openings having a size of 0.015 inches2 or less.

19. The combustor in accordance with claim 14, wherein the screen filter comprises a substantially constant mesh size, the mesh size comprising openings having a range of between 0.0009 and 0.0025 inches2.

20. The combustor in accordance with claim 14, wherein: the screen filter comprises a predetermined mesh size; the predetermined mesh size corresponding to the smallest channels within the microchannel fuel injector; and the predetermined mesh size corresponding to blockage ratios of at least 50%.

21. A combustor for a combustion turbine engine, the combustor comprising:

a cylindrical cap assembly defined by an outer wall and forming a channel between windows defined through the outer wall toward a forward end of the cap assembly and at least one fuel injector positioned toward an aft end of the cap assembly;

a screen filter, the screen filter being configured to extend over the windows such that, in operation, a supply of compressed air entering the cap assembly through the windows passes through the screen filter first; and a standoff comprising a raised area on an outer surface of the outer wall of the cap assembly and a forward standoff that is positioned just forward of the forward end of the windows;

wherein the screen filter extends over the windows and is supported by the standoff in a raised outboard position in spaced relation to the outer surface of the outer wall and a reference plane, the reference plane comprising a smooth continuation of the outer surface of the outer wall if it were extended through the windows.

* * * * *